US006783831B2

(12) United States Patent
Cho

(10) Patent No.: US 6,783,831 B2
(45) Date of Patent: Aug. 31, 2004

(54) SANITARY, LIQUID RESISTANT, DISPOSABLE, ADHESIVE SIDED, FOLDED PLACEMAT

(76) Inventor: Henry Cho, 420 Calle de Felipe, Torrance, CA (US) 90505-6123

( * ) Notice: Subject to any disclaimer, the term of this patent is extended or adjusted under 35 U.S.C. 154(b) by 0 days.

(21) Appl. No.: 10/067,560

(22) Filed: Feb. 4, 2002

(65) Prior Publication Data

US 2002/0160184 A1 Oct. 31, 2002

Related U.S. Application Data

(60) Provisional application No. 60/265,939, filed on Feb. 2, 2001.

(51) Int. Cl.[7] ..... B32B 29/06; B32B 7/12

(52) U.S. Cl. ..... 428/43; 428/211; 428/343; 428/511; 428/537.5; 428/351; D6/613

(58) Field of Search ..... 428/43, 195, 211, 428/343, 355 RA, 511, 537.5, 351; D6/613

(56) References Cited

U.S. PATENT DOCUMENTS 3,673,052 A * 6/1972 Small et al. ..... 156/164
4,457,964 A * 7/1984 Kaminstein ..... 428/43
5,712,012 A * 1/1998 Forman et al. ..... 428/43
6,431,089 B1 * 8/2002 O'Brien ..... 108/90
2002/0160184 A1 * 10/2002 Cho ..... 428/351
2003/0064189 A1 * 4/2003 Berg et al. ..... 428/40.1

* cited by examiner

*Primary Examiner*—Daniel Zirker
(74) *Attorney, Agent, or Firm*—Miller & Martin PLLC

(57) ABSTRACT

This place is made of cellulosic material with a top and bottom planar surface and a peripheral edge. Approximately 75% of the bottom surface is covered with adhesive to keep small children from pulling the placemat off the surface it is adhering The top surface is liquid-resistant to keep it from functioning due to tears in the paper. The placemat is uniquely folded to ensure the operational side remains unexposed to the elements and to avoid using release tape for the adhesive. The placemat is also disposable making it convenient to use. The placemat is folded to be an individual package making it convenient to carry and distribute. The placemat is easy to place onto a surface and remove. The placemat is essential to keep young children from eating off of unsanitary surfaces and moving existing placemats with ease.

5 Claims, 2 Drawing Sheets

SANITARY, LIQUID RESISTANT, DISPOSABLE, ADHESIVE SIDED, FOLDED PLACEMAT

CROSS-REFERENCE

This is a continuation application of U.S. Pat. Ser. No. 60/265,939 filed on Feb. 2, 2001 in the name of Henry Chulsang Cho.

STATEMENT REGARDING FEDERALLY SPONSORED R & D

Not applicable

REFERENCE TO SEQUENCE LISTING

Not applicable

BACKGROUND OF THE INVENTION

Many placemats are available to the consumer, but this particular placemat is unique by being self-contained and by having the operational side remain unexposed by the unique folding process. Other placemats are packaged in bulk, making them inconvenient and unsanitary. Other placemats are on a roll like paper towels, this may eliminate some of the release paper, but the operational side is still exposed to the elements. A roll is also an inconvenient way to transport placemats. It is hard to put a roll of paper towels in a purse or diaper bag in order to travel with only a few placemat one must tear a few off the roll and that leaves the operational side exposed and the adhesive side will also be exposed and adhere to anything it touches lessening it's effectiveness. Other placemats must be taken out of their original packaging and then carried to the place of use. The operational side of these types of placemats are exposed to the elements, therefore are not much more sanitary than the surface they are supposed to cover. Other placemat must be transported in their original package to avoid most exposure to the elements, but once taken from the original container they are immediately exposed. Carrying placemats in bulk takes up too much room in a purse or a diaper bag.

Small et al., U.S. Pat. No. 3,673,052 have used patterned cellular sheets as placemats. Kaminstein, U.S. Pat. No. 4,457,964 discloses a non-slip placemat using webbing instead of adhesive. Forman, et al., US Pat. No. 5,712,012 disposable placemat requires release paper, must be perforated to be torn to "fit" a tray table, and it's on a roll.

Some placemats have some type of adhesive, but it is normally non-existent or maybe just a few strips. Other placemats with a few small strip of adhesive doesn't deter a small child from pulling them off the surface they are suppose to be adhering to. Also, the adhesive used in other placemats requires release paper to expose the adhesive adding to waste and inconvenience. Other placemats with adhesive are made of pliable plastic and usually wrinkle and lose the shape intended. Other placemats of this type are not easy to place on a surface with little adhesive. Other placemats require release paper, which not only adds more waste, it makes the simple process of placing a placemat on a surface into a multi-step process. Other placemats with adhesive strips with release paper make it difficult to hold a small child and perform the actions required to place the placemat on the surface intended. This particular placemat has two small tabs that one pulls to easily pull the adhesive apart and open the placemat. Other placemats have no adhesive at all making it almost impossible to keep a child from moving it. Other placemats are no made of liquid-resistant material and when exposed to liquids tear easily rendering them useless. Other placemats made of plastic are waterproof so when placing food such as green beans, carrots, or any other food with liquid in it the placemat cannot absorb any of the moisture and leaves the placemat covered in liquid. And if a child spills a liquid the results are the same.

BRIEF SUMMARY OF INVENTION

This individual, sanitary, liquid-resistant, disposable, adhesive sided, uniquely folded placemat solves many problems other placemats encounter. First, it is individual, making it easy to transport in a diaper bag, purse, or even a pocket (FIGS. 10 and 11). One or more of these placemats can be carried easily and conveniently. The unfolded placemat is approximately 11 inches×17 inches, although sizes may vary. The folded version of this size is only 2⅛ inches×11 inches (FIG. 10). Also, by being individual it can be easily distributed by restaurants, airlines, fast-food chains, etc. Secondly, this particular placemat is sanitary because the operational side is not exposed to the elements (FIG. 3). Next, this placemat is liquid-resistant, not waterproof, so it can handle small amounts of liquids consistently like those found with vegetables and fruits. Since it is liquid-resistant is will not tear easily when exposed to moisture. Next, it is disposable making it convenient and sanitary, no carrying a soiled placemats around in a diaper bag or purse. Next, it is adhesive sided, not just a few adhesive strips. This placemat has a Back Side that is approximately 75% adhesive (FIG. 2) making it difficult for a small child to pull off the surface it is adhering to. It is also made of a cellulosic material, preferably recycled paper, so it will not lose shape easily when unfolded. The release tabs (FIG. 2) make it easy to open the menu instead of tearing one off a roll and dealing with release paper to expose the adhesive. The adhesive of this particular placemat doesn't require release paper so there is no extra effort or waste. Next, it is uniquely folded so that the operational side is unexposed to the elements. The adhesive doesn't require release due to the unique folding adhesive on adhesive to adhere each fold (FIGS. 6 and 9). This placemat is uniquely folded so it can be transported individually and stay sanitary making it convenient and clean. This particular placemat is uniquely folded so if distributed by restaurants, airlines, fast-food chains, etc. it will remain sanitary since the operational side is unexposed. The exposed sides of this placemat can be use for advertising, directions, etc. (FIG. 10). The exposed sides are in itself the packaging to the placemat so shrink wrap or plastic covering is needed. No rolls or large containers are needed to transport this particular placemat. The Front Side may be use for advertising, menus, games or any type of drawings a small child may find attractive. The Front Side may also be blank allowing a small child to use any type of writing utensil to draw or color.

DESCRIPTION OF THE INVENTION DRAWINGS

Figure 1:
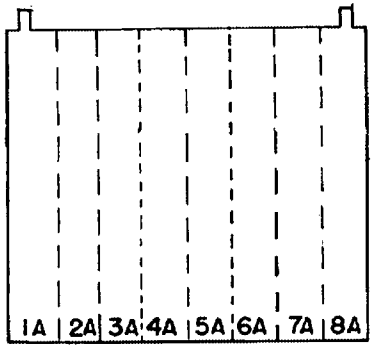
FIG. 1 view from Front Side
FIG. 2 view from Back Side
FIG. 3 view from Back Side
FIG. 4 view from Front Side
FIG. 5 view from Back Side
FIG. 6 view from Back Side
FIG. 7 view from Front Side -continued FIG. 8 view from Back Side
FIG. 9 view from Back Side
FIG. 10 view from Back Side
FIG. 11 view from Back Side
FIG. 12 view from Back Side

FIG. 1 shows the operational side or Front Side of the placemat.

Figure 2:
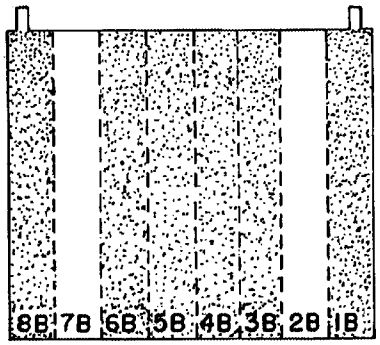

FIG. 2 shows the adhesive side or Back Side of the placemat where six of the eight panels are covered with adhesive.

Figure 3:
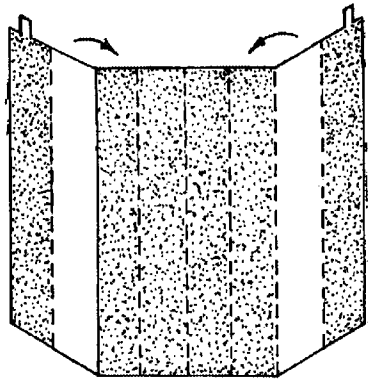

FIG. 3 shows the first fold from the Back Side where the Front Side is unexposed by the first fold.

Figure 4:
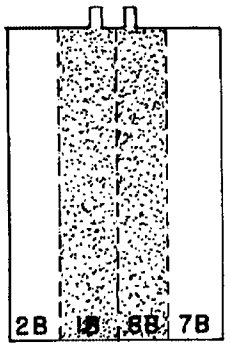

FIG. 4 shows the Front Side after the first fold where two panels have adhesive and two do not.

Figure 5:
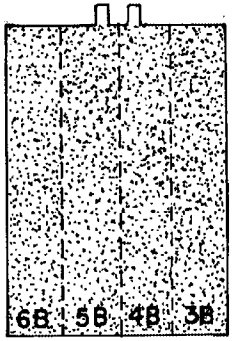

FIG. 5 sows the Back Side after the first fold where all the panels have adhesive.

Figure 6:
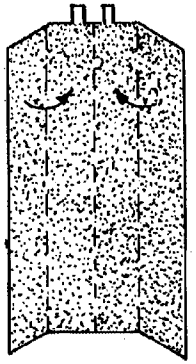

FIG. 6 shows the second fold from the Back Side where adhesive is adhering to adhesive.

Figure 7:
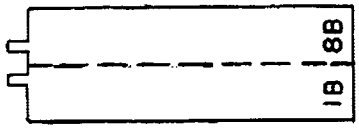

FIG. 7 shows the Front Side after the second fold with two panels covered with adhesive.

Figure 8:
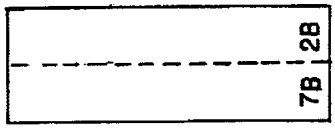

FIG. 8 shows the Back Side after the second fold with two non-adhesive panels.

Figure 9:
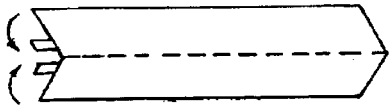

FIG. 9 shows the third fold from the Back Side where adhesive is once again adhering to adhesive.

Figure 10:
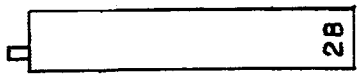

FIG. 10 shows the finished folded placemat with the two non-adhesive panels are the only panels left exposed. These are on the Back Side so any exposure to the elements is on the Back Side not the operational side or Front Side.

Figure 11:
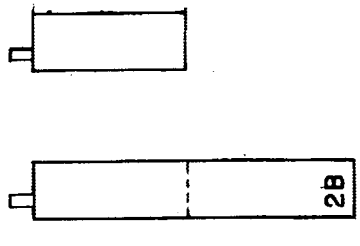

FIG. 11 shows an alternate finished fold where the placemat is folded reducing the size in half and only one of the non-adhesive sides is exposed.

Figure 12:
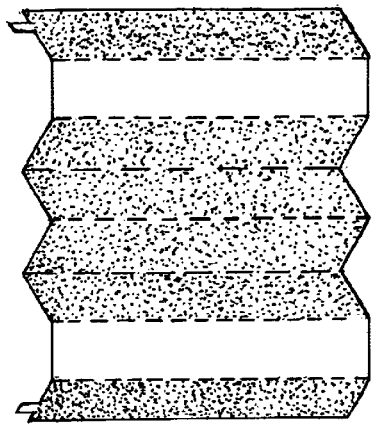

FIG. 12 shows the Back Side of the unfolding the placemat where six of the eight panels are covered with adhesive.

DETAILED DESCRIPTION OF THE INVENTION

This invention of an individual, sanitary, liquid-resistant, disposable, adhesive sided, uniquely folded placemat is intended, but not solely, for use by small children. It is commonly known that small children eat off a table or highchair tray instead of a plate that they can turn over. Unfortunately, small children must eat off of unsanitary surfaces. This particular placemat provides a sanitary way for a child to eat food off a table or highchair tray without a plate or other placemats that the child can pick up and move. The size of the placemat is approximately 11 inches× 17 inches although may vary. The Front Side is liquid-resistant so it won't tear when fluids are spilled on it Water-resistant coatings, for example, are wax, silicone, polymers, dry oils, resins, or any similar suitable coating The coating is to be non-toxic. Preferably the coating would be impregnated into the paper. This particular placemat has four sides, and has a planar surface. It also has a peripheral edge. This placemat is made of cellulosic material preferably recycled paper. This placemat is uniquely folded in such a way that the operative surface (Front Side FIG. 1) is not contaminated by outside elements until opened. Other placemats are exposed to the elements so they are contaminated before even used. This particular placemat has two small tabs, which may be used to pull apart the adhesive and open the placemat.

The Back Side of the placemat (FIG.2) has approximately 75% of it's surface area covered with adhesive making it difficult for a small child to pull off the placemat from the surface it is adhering to. Other placemats offer no or little adhesive to prevent a small child from removing it from the surface it is placed upon. There are small tabs on each side of the placemat (FIG. 2) in order to pull the folded placemat apart. The tabs are non adhesive. The adhesive is non-toxic and leaves little or no residue on the surface it is adhering to. The adhesive is pressure sensitive but releasable so the placemat can be applied to a surface more than one time if needed. Examples of adhesive are waterbased, acrylate, 2-sided adhesive tape, or any similar suitable adhesive. The adhesive is preferably liquid-resistant. Although having only the Front Side liquid-resistant would be more cost effective.

The completely folded placemat is folded into eight equally sized panels and when folded six of the eight panels on the Back Side have adhesive (FIG. 2), thus approximately 75% of the surface area. Preferably, all panels requiring adhesive are covered completely. The first fold places the Front Side inside so it is not contaminated (FIG. 3). Now only the Back Side is exposed (FIGS. 4 and 5). The second fold places adhesive on adhesive (FIG. 6) so the adhesive sides can stick to each other eliminating any type of release paper to peel off and discard. Now there are two adhesive panels exposed on one side, and two non-adhesive sides on the other (FIGS. 7 and 8). The third fold places adhesive on adhesive again without any release paper to peel off and discard (FIG. 9). Now the placemat is in the finished folded position (FIG. 10) or folding in half (FIG. 1) can reduce the size again. These two panels are exposed for packaging and handling; therefore they do not have adhesive. Both sides of the finished folded placemat may be used for advertising, directions for use, designs, etc. The finished folded placemat is in effect it's own package. No shrink-wrap or plastic covering is necessary because the operational side is folded inside, therefore staying unexposed. The two panels of the placemat that are exposed are on the Back Side so when the placemat is in use, food does not come in contact with the two exposed panels. This does not deter the uniquely folded placemat from adhering to the surface intended because six of the eight panels have adhesive, approximately 75% of the surface area. By being uniquely folded, the placemat is individual, making the placemat easy to transport in a diaper bag, purse, or even a pocket. Because said placemat is individual distributing the placemat at restaurants, fast-food chains and airplanes, etc., is simple and sanitary due to the uniquely folding process. Not only is this particular placemat sanitary by uniquely folding the Front Side inside keeping the operational side from being exposed, this particular placemat is disposable so after use the placemat is simply discarded.

The Front Side may have designs or games consistent with other placemats. The Front Side may also have advertisements or menus and the name of the placemat on it The placemat has three layers, the liquid-resistant coat, the cellulosic material (preferably recycled paper) and the adhesive coating on six of the eight panels. If possible, the Back Side can have a liquid-resistant coating although this may not be cost effective.

Because the placemats are uniquely folded, said placemats can be stacked easily for shipping and storage. Even though the outside packaging of the stacked placemats is opened, the Front Side stays unexposed due to the unique folding process. Binders may also be used to stack placemats eliminating outside packaging reducing cost and waste. All printing used on the placemats is to be non-toxic and liquid-resistant.

What is claimed is:

1. A folded placemat comprising:

A sheet of cellulosic material having a top and bottom planar surface and a peripheral edge wherein the peripheral edge of the sheet has at least four sides:

said top planar surface comprising a moisture-resistant coating;

said bottom planar surface having a pressure sensitive adhesive applied thereto for fixing said placemat to an eating surface;

said placemat provided in a packaged configuration wherein the top planar surface is folded along at least one edge providing at least a first and a second section with said first and second section parallel to one another and contacting one another thereby preventing the first and second sections from contacting another surface while in the packaged configuration and wherein the sheet is folded to have eight panels, said first and said second sections located on a top surface of two of the eight panels, and top surface portions of each of said eight panels contacting and parallel with at least one of the other of the eight top surface portions of the panels while in the packaged configuration thereby providing a sanitary too planar surface;

said placemat further having a deployed configuration wherein the first and second sections are displaced from contact with one another by unfolding, thereby exposing the top planar surface for use as a placemat.

2. The placemat of claim 1 wherein the eight panels each have a bottom surface which collectively form the bottom planar surface, six of said eight panels provided with the pressure sensitive adhesive: an outer two of the eight panels, and an inmost four of the eight panels.

3. The placemat of claim 1 wherein the bottom planar surface is provided with a water resistant coating in addition to the adhesive.

4. The placemat of claim 1 further comprising tabs connected to the first and second sections wherein the tabs extend past the peripheral edge of the sheet and assist in transitioning the placemat from the packaged configuration to the deployed configuration.

5. The placemat of claim 1 further comprising tabs connected an outer two of the eight panels and extend past the peripheral edge of the sheet, wherein the tabs assist in transitioning the placemat from the packaged configuration to the deployed configuration.

* * * * *